US009856105B2

(12) United States Patent
Mutsuno et al.

(10) Patent No.: US 9,856,105 B2
(45) Date of Patent: Jan. 2, 2018

(54) SHEET PROCESSING APPARATUS, METHOD FOR CONTROLLING SHEET PROCESSING APPARATUS, AND STORAGE MEDIUM

(71) Applicant: CANON KABUSHIKI KAISHA, Tokyo (JP)

(72) Inventors: Masahiro Mutsuno, Tokyo (JP); Masaki Kashiwagi, Hiratsuka (JP); Satoshi Totsuka, Toride (JP); Akinori Takeo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 181 days.

(21) Appl. No.: 14/968,743

(22) Filed: Dec. 14, 2015

(65) Prior Publication Data

US 2016/0185560 A1 Jun. 30, 2016

(30) Foreign Application Priority Data

Dec. 25, 2014 (JP) ..... 2014-263177

(51) Int. Cl.

| | |
|---|---|
| ***B65H 43/00*** | (2006.01) |
| ***B65H 37/04*** | (2006.01) |
| ***B65H 43/02*** | (2006.01) |
| ***B41L 43/12*** | (2006.01) |
| ***B31F 5/00*** | (2006.01) |

(Continued)

(52) U.S. Cl.

CPC ..... *B65H 43/00* (2013.01); *B31F 5/001* (2013.01); *B41F 13/66* (2013.01); *B41L 43/12* (2013.01); *B42B 4/00* (2013.01); *B42C 1/12* (2013.01); *B65H 37/04* (2013.01); *B65H 43/02* (2013.01); *G03G 15/6544* (2013.01);

(Continued)

(58) Field of Classification Search

CPC ..... B65H 43/00; B65H 43/02; B65H 37/04; B41L 43/12; B31F 5/001; B42C 1/12; G03G 2215/00827

USPC ..... 270/1.01, 58.02, 58.09

See application file for complete search history.

(56) References Cited

U.S. PATENT DOCUMENTS 4,801,133 A * 1/1989 Ishiguro ..... B42C 1/125 227/78

9,067,337 B2 * 6/2015 Nagasaki ..... B27F 7/17

(Continued)

FOREIGN PATENT DOCUMENTS

JP 2011003005 A 1/2011

JP 2014162590 A 9/2014

*Primary Examiner* — Leslie A Nicholson, III

(74) *Attorney, Agent, or Firm* — Canon USA, Inc., IP Division

(57) ABSTRACT

A sheet processing apparatus including a stapler for executing a stapling process, a sheet detection sensor for detecting a sheet as a processing target, and an execution button for receiving from a user an execution instruction to execute the stapling process, after the sheet detection sensor detects a sheet, in a case where the execution button is pressed before a predetermined time elapses, causes the stapler to execute the stapling process according to the execution button being pressed, and in a case where the execution button is not pressed, causes the stapler to execute the stapling process according to lapse of the predetermined time. Further, the sheet processing apparatus sets whether the execution of the stapling process according to the lapse of the predetermined time is enabled.

18 Claims, 11 Drawing Sheets

(51) Int. Cl.

| | |
|---|---|
| ***B42C 1/12*** | (2006.01) |
| ***B42B 4/00*** | (2006.01) |
| ***G03G 15/00*** | (2006.01) |
| ***B41F 13/66*** | (2006.01) |

(52) U.S. Cl.
CPC ..... *B65H 2408/1222* (2013.01); *G03G 2215/00827* (2013.01); *G03G 2215/0177* (2013.01)

(56) References Cited

U.S. PATENT DOCUMENTS

| | | | | |
|---|---|---|---|---|
| 9,248,581 | B2 * | 2/2016 | Misumi | B27F 7/36 |
| 2013/0215481 | A1 * | 8/2013 | Hayasaka | G03G 15/607 358/498 |
| 2015/0048137 | A1 * | 2/2015 | Misumi | B27F 7/36 227/19 |

* cited by examiner

| |
|---|
| FIG. 7A |
| FIG. 7B |

FIG. 8

| | MANUAL EXECUTION | AUTOMATIC EXECUTION |
|---|---|---|
| USER A | ENABLED | ENABLED |
| USER B | ENABLED | DISABLED |
| USER C | DISABLED | ENABLED |
| ... | | |
| ... | | |

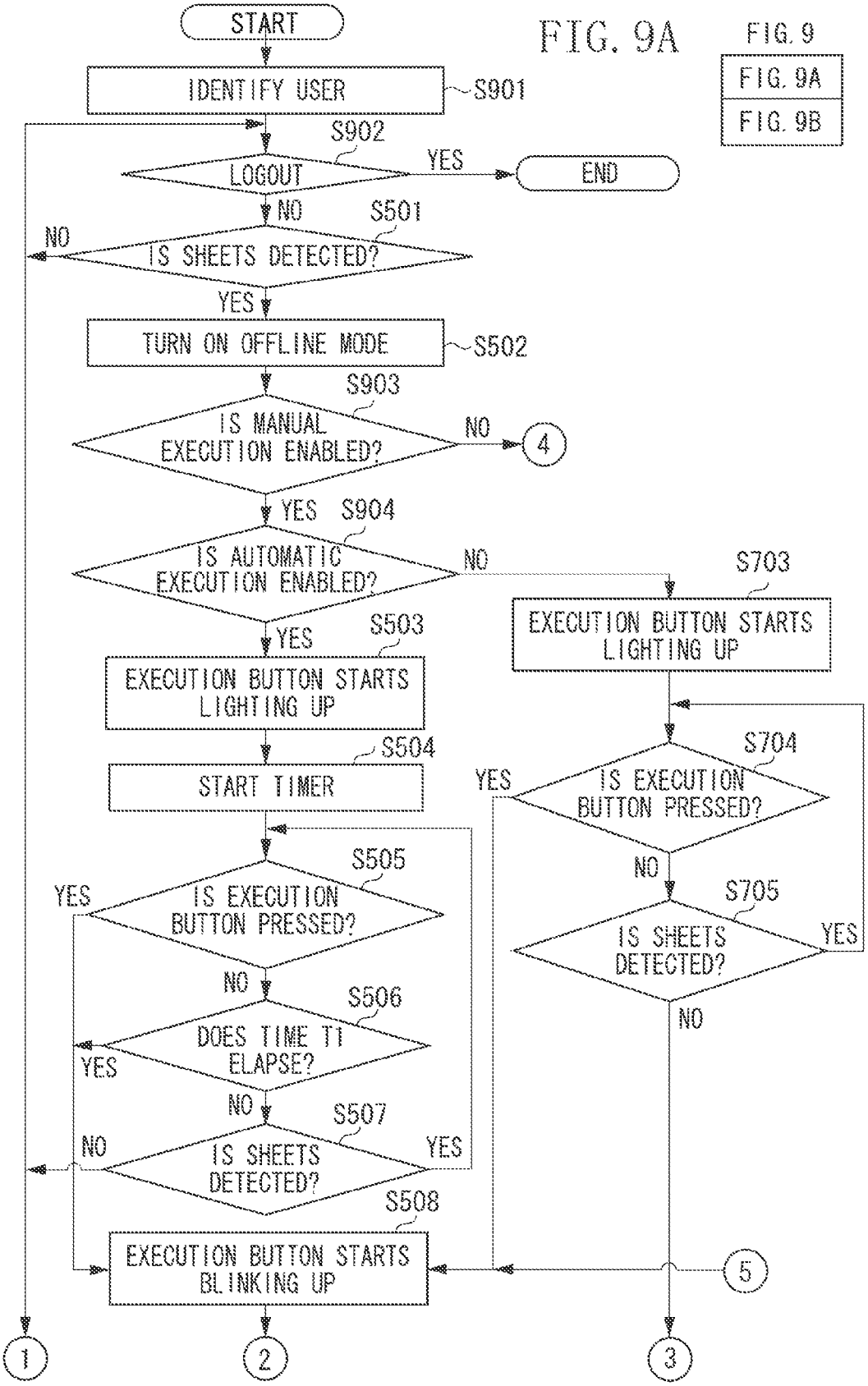
FIG. 9A
FIG. 9
FIG. 9A
FIG. 9B
START
IDENTIFY USER
S901
S902
LOGOUT
YES
END
NO
S501
NO
IS SHEETS DETECTED?
YES
TURN ON OFFLINE MODE
S502
S903
IS MANUAL EXECUTION ENABLED?
NO
4
YES
S904
IS AUTOMATIC EXECUTION ENABLED?
NO
S703
EXECUTION BUTTON STARTS LIGHTING UP
YES
S503
EXECUTION BUTTON STARTS LIGHTING UP
S504
START TIMER
S704
YES
IS EXECUTION BUTTON PRESSED?
NO
S705
IS SHEETS DETECTED?
YES
NO
S505
YES
IS EXECUTION BUTTON PRESSED?
NO
S506
DOES TIME T1 ELAPSE?
YES
NO
S507
NO
IS SHEETS DETECTED?
YES
S508
EXECUTION BUTTON STARTS BLINKING UP
5
1
2
3

SHEET PROCESSING APPARATUS, METHOD FOR CONTROLLING SHEET PROCESSING APPARATUS, AND STORAGE MEDIUM

BACKGROUND OF THE INVENTION

Field of the Invention

The present invention relates to a sheet processing apparatus for performing processing on a sheet.

Description of the Related Art

Conventionally, a sheet processing apparatus for performing processing on a sheet is known. As specific examples of the processing on a sheet, a binding process (stapling) for binding a plurality of sheets using a staple, a stapleless binding process (stapleless stapling) for binding a plurality of sheets by fastening a plurality of sheets without using a staple, and a punching process for punching a hole in a sheet are known. These processes are referred to as the "sheet processing".

As an example of the sheet processing apparatus, there is a sheet processing apparatus used by being connected to a printing apparatus for printing an image on a sheet. In a case where the sheet processing apparatus and the printing apparatus are connected together, the sheet processing apparatus is connected downstream of the printing apparatus in the conveying direction of the sheet. Then, the sheet processing apparatus receives from the printing apparatus the sheet on which the image is printed, and performs sheet processing on the received sheet.

Further, a sheet processing apparatus capable of performing sheet processing involved in the printing of an image by a printing apparatus and also capable of performing sheet processing not involved in the printing of an image by the printing apparatus is also known. Japanese Patent Application Laid-Open No. 2014-162590 and Japanese Patent Application Laid-Open No. 2011-003005 each discuss a printing system having the function of performing sheet processing involved in the printing of an image by a printing apparatus and the function of performing sheet processing not involved in the printing of an image by the printing apparatus.

In the printing system discussed in Japanese Patent. Application Laid-Open No. 2011-003005, two types of modes are provided as a mode for performing sheet processing not involved in the printing of an image by the printing apparatus. One is a mode for executing sheet processing according to the fact that a predetermined time (e.g., 10 seconds) elapses since a sheet has been set. The other is a mode for executing sheet processing according to the fact that a user performs a predetermined operation (for example, presses a button) after a sheet is set.

In the printing system discussed in Japanese Patent Application Laid-Open No. 2011-003005, it LS possible to set in advance in which mode sheet processing is to be executed, with respect to each content of sheet processing. For example, it can be set so that a stapling process is executed according to the fact that the predetermined time elapses since a sheet has been set, and so that a punching process is executed according to the fact that a user performs the predetermined operation after a sheet is set.

However, even if the content of sheet processing is the same, depending on the user or depending on the case even if the user is the same, there are a situation where the user hopes that sheet processing is executed without performing the predetermined operation, and a situation where the user hopes that sheet processing is executed without waiting for the lapse of the predetermined time. Possible examples of the first situation include a case where the user holds a sheet as a processing target in one hand and a piece of baggage in the other hand, and therefore, it is difficult to perform an operation such as pressing a button. Possible examples of the second situation include a case where the user wishes to speed up work in a case where sheet processing is successively performed on a plurality of sheet bundles.

SUMMARY OF THE INVENTION

According to an aspect of the present invention, a sheet processing apparatus includes a sheet processing unit configured to execute sheet processing, a detection unit configured to detect a sheet as a processing target, a reception unit configured to receive an execution instruction to execute the sheet processing from a user, a control unit configured to, after the detection unit detects a sheet, in a case where the reception unit receives the execution instruction before a predetermined time elapses, the sheet processing unit to execute the sheet processing according to reception of the execution instruction, and in a case where the reception unit does not receive the execution instruction, cause the sheet processing unit to execute the sheet processing according to lapse of the predetermined time, and a setting unit configured to set whether execution of the sheet processing according to the lapse of the predetermined time is enabled.

Further features of the present invention will become apparent from the following description of exemplary embodiments with reference to the attached drawings.

BRIEF DESCRIPTION OF THE DRAWINGS

FIG. 8 is a diagram illustrating a user management table stored in the sheet processing apparatus according to an exemplary embodiment of the present invention.

DESCRIPTION OF THE EMBODIMENTS

Exemplary embodiments of the present invention will be described in detail below with reference to the drawings.

Figure 1:
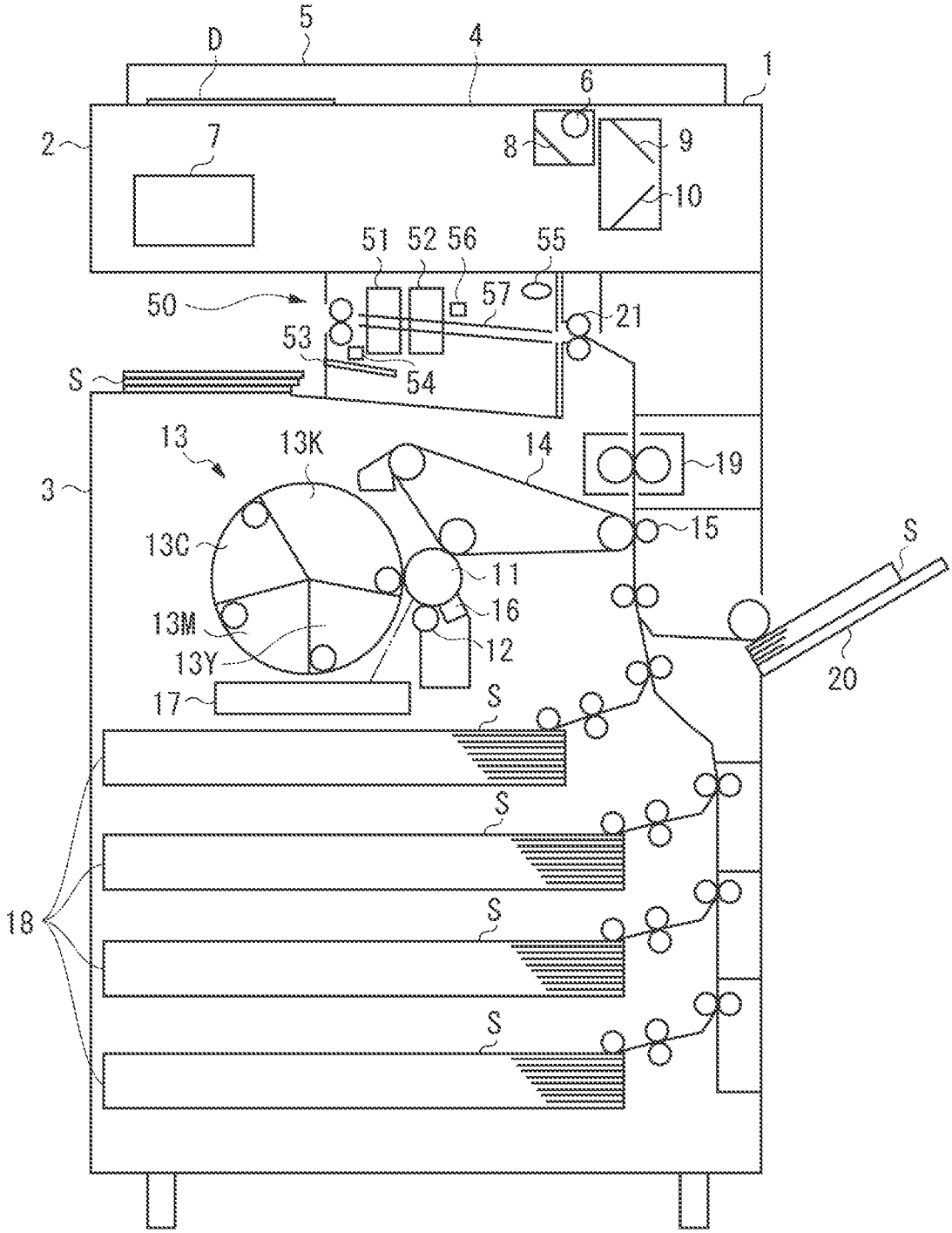
FIG. 1 is a cross-sectional view of a printing system according to an exemplary embodiment of the present invention.

FIG. 1 illustrates a cross-sectional view of the entirety of a printing system including a sheet processing apparatus 50, to which the present invention is applied, and a printing apparatus 1, to which the sheet processing apparatus 50 is connected. Although a description is given here on the assumption that the sheet processing apparatus is distinguished from the printing apparatus 1, the entirety of the printing apparatus 1 including the sheet processing apparatus 50 may be referred to as a "printing apparatus", or the entirety of the sheet processing apparatus 50 including the printing apparatus 1 may be referred to as a "sheet processing apparatus".

The printing apparatus 1 includes two main components, namely a scanner 2, which reads an image on a document to generate image data, and a printer 3, which forms an image on a sheet. In an upper portion of the scanner 2, a document platen 4, which includes a transparent glass plate, is provided. A document D is set at a predetermined position on the document platen 4 such that an image to be read faces downward. Then, the document D is pressed and fixed by a document press contact plate 5. Under the document platen 4, optical system members are provided. The optical system members include a lamp 6, which irradiates the document D with light, and reflecting mirrors 8, 9, and 10, which guide reflected light to an image processing unit 7. The document D is scanned by the lamp 6 and the reflecting mirrors 8, 9, and 10 moving at a predetermined speed.

The printer 3 includes a photosensitive drum 11, a primary charging roller 12, a rotary developing unit 13, an intermediate transfer belt 14, a transfer roller 15, and a cleaner 16. On the surface of the photosensitive drum 11, an electrostatic latent image is formed by laser light emitted from a laser unit 17 based on image data generated by reading of the image on the document D. The primary charging roller 12 uniformly charges the surface of the photosensitive drum 11 before the laser light is emitted.

The rotary developing unit 13 applies toners of colors including magenta (M), cyan (C), yellow (Y), and black (K) to the electrostatic latent image formed on the surface of the photosensitive drum 11, thereby forming a toner image. The toner image developed on the surface of the photosensitive drum is transferred onto the intermediate transfer belt 14, and the toner image on the intermediate transfer belt 14 is transferred onto a sheet S by the transfer roller 15. The cleaner 16 removes the toner remaining on the photosensitive drum 11 after the toner image is transferred.

The rotary developing unit 13 uses a rotation developing method and includes developing devices 13K, 13Y, 13M, and 13C. The rotary developing unit 13 is provided to be rotatable by a motor (not illustrated). When a monochrome toner image is formed on the photosensitive drum 11, the developing device 13K is rotationally moved to a developing position near the photosensitive drum 11, thereby developing an image. When a full-color toner image is formed, the rotary developing unit 13 is rotated so that each developing device is arranged at a developing position, whereby an image with respect to each color is sequentially developed.

The sheet S onto which the toner image on the intermediate transfer belt 14 is to be transferred is supplied to a transfer position from a cassette 18 or a manual-bypass tray 20. A fixing device 19 is provided downstream of the transfer roller. 15 in the conveying direction and fixes the toner image on the conveyed sheet S. The sheet S on which the toner image is fixed is discharged from the printing apparatus 1 to the sheet processing apparatus 50 downstream in the conveying direction by a pair of discharge rollers 21.

The sheet processing apparatus 50 is connected to a sheet discharge position of the printing apparatus 1 and also configured to communicate with the printing apparatus 1 via a signal line (not illustrated). The sheet processing apparatus 50 communicates with the printing apparatus thereby operating cooperatively with the printing apparatus 1. For the sheet S discharged by the pair of discharge rollers 21, the sheet processing apparatus 50 includes a stapler 51, which binds a plurality of sheets using a staple, and a stapler 52, which binds a plurality of sheets without using a staple. As will be described later with reference to FIG. 3, the stapler 51 is movable and can execute a binding process in a plurality of places, while the stapler 52 is fixed in a single place. Alternatively, the stapler 52 may also be configured to be movable. Further, in addition to the staplers, a puncher for punching a hole in a sheet may be provided.

The sheet processing apparatus 50 includes a sheet detection sensor 56, which detects the presence or absence of the sheet S, and a sheet alignment unit 57, which aligns the sheet S. The sheet processing apparatus 50 detects, using the sheet detection sensor 56, the sheet S conveyed to the sheet alignment unit 57. Then, according to specifying from a user, the sheet processing apparatus 50 performs a binding process (stapling) by the stapler 51, or performs another binding process (stapleless stapling) by the stapler 52.

Further, the sheet processing apparatus 50 has an offline stapling function for executing a binding process not on a sheet supplied from the cassette 18 or the manual-bypass tray 20, but on a sheet directly set in the sheet processing apparatus 50 by the user. When offline stapling is executed, a binding process using a staple by the stapler 51 is performed. A sheet insertion opening 53 is the place where the user using the offline stapling function inserts a sheet as a processing target. The sheet insertion opening 53 is formed into a slit shape, and the user inserts the sheet into the slit. The sheet detection sensor 54 detects that a sheet is inserted into the sheet insertion opening 53.

If the sheet detection sensor 54 detects a sheet, the sheet processing apparatus 50 shifts to an offline mode (the offline mode is turned on). The user presses an execution button 55 in the state where the offline mode is on, whereby a stapling process is executed by the stapler 51. Further, even if the execution button 55 is not pressed, a stapling process is automatically executed when the sheet detection sensor 54 continues to detect a sheet for a predetermined time.

While the offline mode is on, an image printing operation by the printing apparatus 1 is restricted. Thus, the printing apparatus 1 does not convey a sheet to the sheet processing apparatus 50. Further, in the execution button 55, a light-emitting diode (LED) capable of lighting up and blinking is provided and notifies the user of the state of the sheet processing apparatus 50 by lighting up or blinking. Lighting up means that the execution button 55 can be pressed (that is, an instruction to execute sheet processing can be given). Further, blinking means that sheet processing is to be executed soon. Instead of the notification using the LED, the notification may be given by displaying a message or outputting a sound.

Figure 2A:
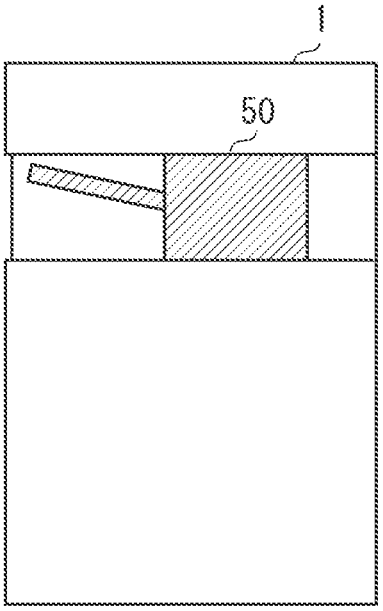
FIGS. 2A and 2B are schematic diagrams illustrating examples of connection between a printing apparatus and a sheet processing apparatus according to the exemplary embodiment of the present invention.
Figure 2B:
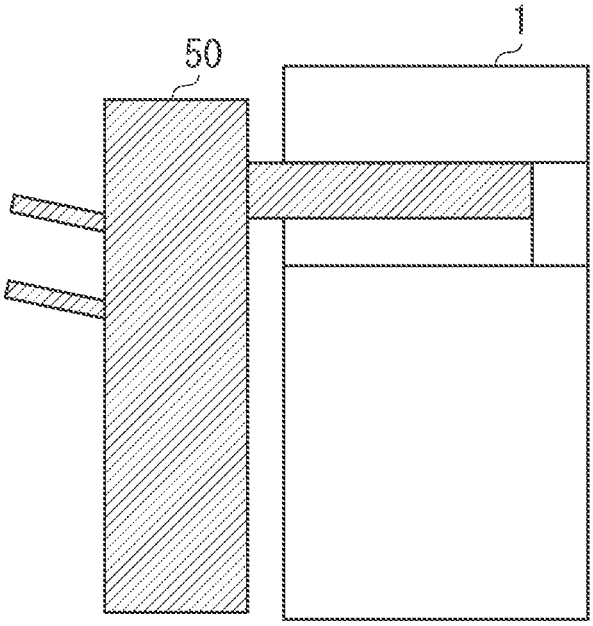

FIGS. 2A and 2B are schematic diagrams illustrating examples of the connection of the sheet processing apparatus 50 to the printing apparatus 1. FIG. 2A illustrates an example where the sheet processing apparatus 50 is connected to the inside of the body of the printing apparatus 1. FIG. 2B illustrates an example where the sheet processing apparatus 50 is connected to the outside of the body of the printing apparatus 1. In either connection form, the sheet processing apparatus 50 can execute a stapling process on a sheet discharged by the pair of discharge rollers 21 of the printing apparatus 1, and a stapling process on a sheet directly set in the sheet processing apparatus 50 by the user.

Figure 3:
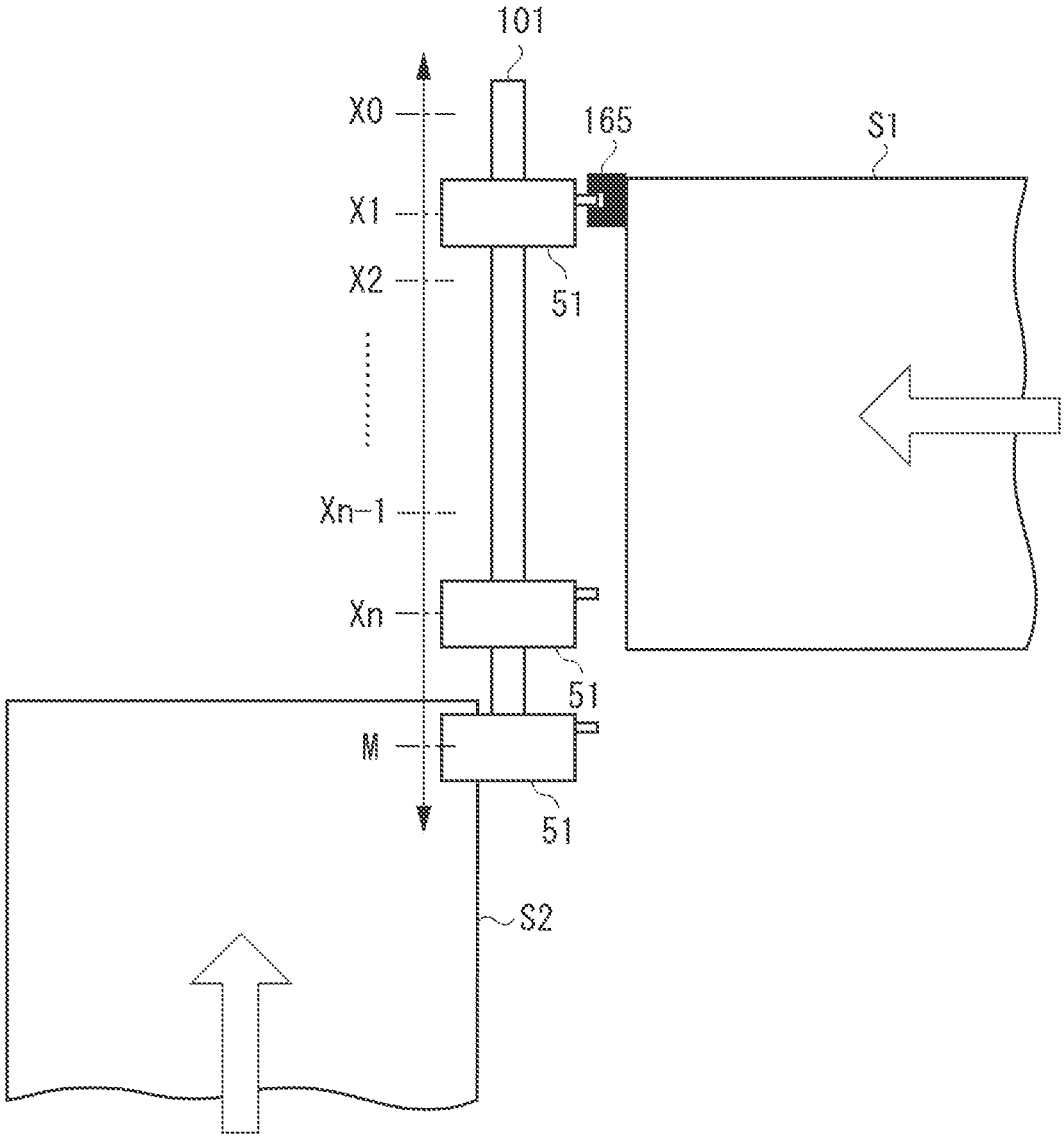
FIG. 3 is a diagram illustrating a configuration of a stapler of the sheet processing apparatus according to the exemplary embodiment of the present invention.

FIG. 3 is a diagram illustrating the configuration of the stapler 51 of the sheet processing apparatus 50. FIG. 3 illustrates a top cross-sectional view of the sheet processing apparatus 50. The lower side of FIG. 3 is the front surface side (the near side) of the printing apparatus 1 illustrated in FIG. 1. The stapler 51 is provided to be movable in the direction of an arrow along a movement path 101. The stapler 51 has two functions. The first function of the stapler 51 is the function of performing a stapling process on a sheet S1 discharged from the printing apparatus 1. The second function of the stapler 51 is the function of performing a stapling process on a sheet S2 inserted into the sheet insertion opening 53.

To staple the sheet S1, it is necessary to perform a stapling process on a stapling position set by the user. Thus, a stapler movement motor 164 (FIG. 4) drives the stapler 51 to move along the movement path 101, whereby it is possible to perform a stapling process on any of positions X1, X2, . . . , Xn−1, and Xn. Although not illustrated in FIG. 3, it is assumed that the stapler 51 is also configured to be movable in an up-down direction (a vertical direction).

On the other hand, to staple the sheet S2, a stapling process is performed on the sheet S2 inserted into the sheet insertion opening 53, which is provided on the front surface (the near side) of the sheet processing apparatus 50. Thus, when a stapling process is executed on the sheet S2, the stapler 51 is moved to a position M on the front surface side (the near side) of the sheet processing apparatus 50.

If the stapler 51 is located on the conveying path of the sheet S1, the stapler 51 hinders the conveyance of the sheet. Thus, when a stapling process by the stapler 51 is not executed, the stapler 51 is retracted to a position X0, which does not hinder the conveyance of the sheet.

Figure 4:
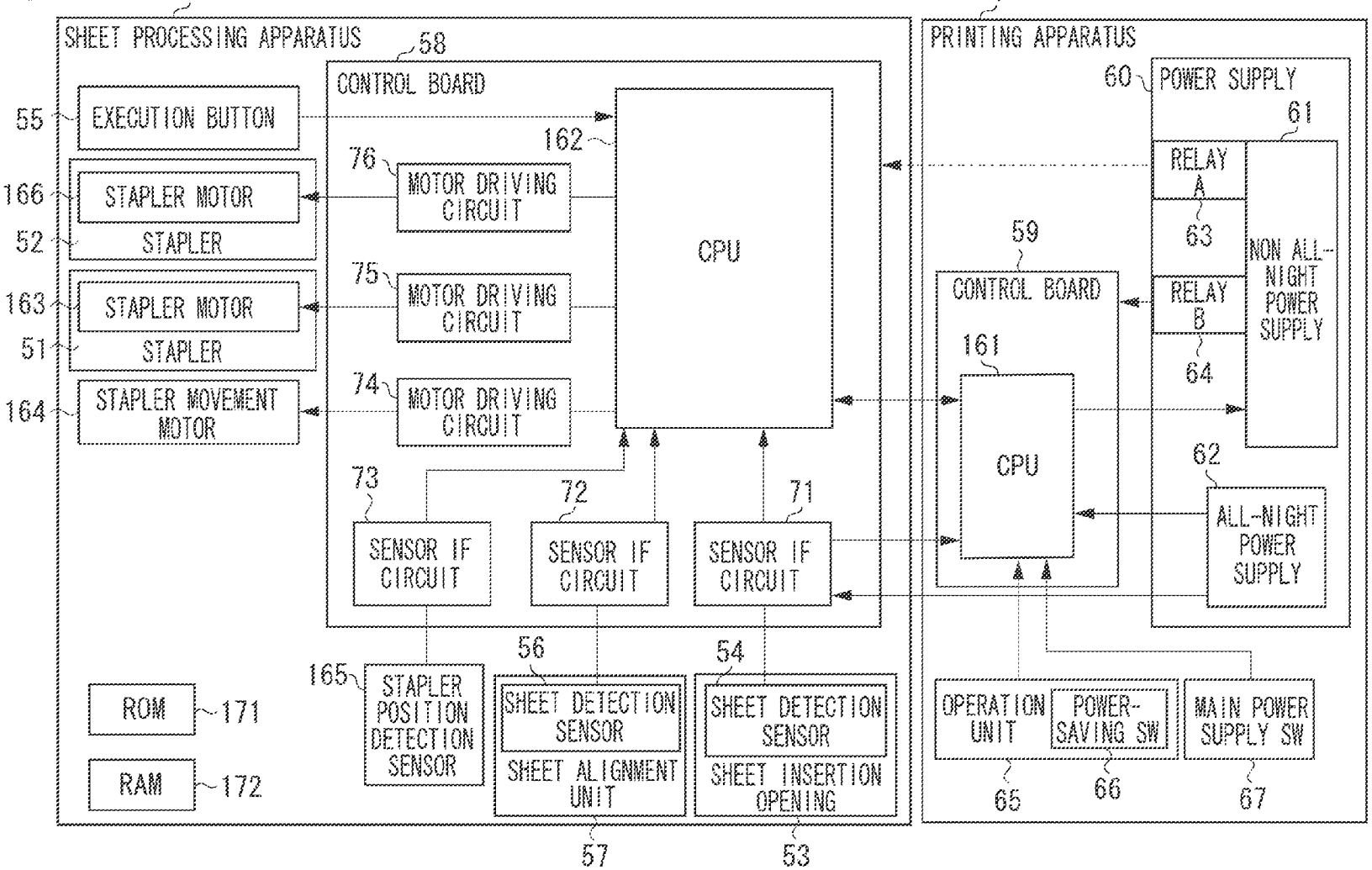
FIG. 4 is a diagram illustrating a hardware configuration of a control system of the printing apparatus and the sheet processing apparatus according to the exemplary embodiment of the present invention.

Next, the configuration of a control system of the printing apparatus 1 and the sheet processing apparatus 50 is described. FIG. 4 is a diagram illustrating a hardware configuration of the control system of the printing apparatus 1 and the sheet processing apparatus 50. In FIG. 4, the printing apparatus 1 includes a control board 59, which includes a central processing unit (CPU) 161, a power supply 60, and an operation unit (reception unit) 65. The sheet processing apparatus 50 includes a control board 58, which includes a CPU 162, a sheet detection sensor 54, a stapler position detection sensor 165, a stapler motor 163, and a stapler movement motor 164.

The CPU 161 of the printing apparatus 1 controls the components of the printing apparatus 1. In a case where it is detected that a sheet is inserted into the sheet insertion opening 53 in the state where the printing apparatus 1 and the sheet processing apparatus 50 are in a power saving mode, the CPU 161 functions as follows. That is, the CPU 161 maintains the printing apparatus 1 in the power saving mode and returns the sheet processing apparatus 50 from the power saving mode. The power supply 60 includes a non-all-night power supply 61, an all-night power supply 62, a relay A 63, and a relay B 64. The non-all-night power supply 61 is connected to the control board 58 via the relay A 63 and connected to the control board 59 via the relay B 64. The all-night power supply 62 is connected to the CPU 161 of the control board 59 and a sensor interface (IF) circuit 71 of the control board 58.

The non-all-night power supply 61 is a power supply capable of supplying or disconnecting power under the control of the CPU 161. The all-night power supply 62 is a power supply for always supplying power in the state where a power plug of the printing apparatus 1 is inserted into an electrical outlet. A main power supply switch (SW) 67 is a switch that is operated for turning on or off the printing apparatus 1. The operation unit 65 is a user interface for making various settings for the printing apparatus 1 and the sheet processing apparatus 50. In the operation unit 65, a power saving SW 66 is provided, which is operated for shifting the printing apparatus 1 to the power saving mode or for returning the printing apparatus 1 from the power saving mode.

The CPU 162 of the sheet processing apparatus 50 is connected to the CPU 161 of the printing apparatus 1. The CPU 162 of the sheet processing apparatus 50 communicates with the CPU 161 of the printing apparatus 1, whereby each of the CPUs 161 and 162 can detect the state of the other apparatus. Further, the CPU 162 reads a control program stored in a read-only memory (ROM) 171 and performs control regarding sheet processing. A random-access memory (RAM) 172 is used as temporary storage areas, such as a main memory and a work area for the CPU 162. In the sheet processing apparatus 50, a single CPU 162 executes each process illustrated in flowcharts described later, using a single memory (the RAM 172). Alternatively, another form may be employed. For example, a plurality of CPUs and a plurality of RAMS, or a hard disk drive (HDD) and a solid-state disk (SSD) can also be caused to cooperate to execute each process. Yet alternatively, part of processing described later may be executed using a hardware circuit, such as an application-specific integrated circuit (ASIC). Further, although not illustrated in FIG. 4, a RAM, a ROM, and an HDD are provided also in the printing apparatus 1.

The CPU 162 of the sheet processing apparatus 50 is connected to the execution button. 55, sensor IF circuits 71, 72, and 73, and motor driving circuits 74, 75, and 76. The CPU 162 controls the components of the sheet processing apparatus 50 via the above circuits. When the sheet processing apparatus 50 shifts to the power saving mode, the CPU 162 controls the stapler 51 to move to the position M.

The sheet detection sensor 56 detects the presence or absence of a sheet in the sheet alignment unit 57 and notifies the CPU 162 of the detection result via the sensor IF circuit 72. The sheet detection sensor 54 detects the presence or absence of a sheet in the sheet insertion opening 53 and notifies the CPU 162 of the detection result via the sensor IF circuit 71. The stapler position detection sensor 165 is provided at a position opposite to the movement path 101 of the stapler 51 (see FIG. 3) and detects the position of the stapler 51. Further, the stapler position detection sensor 165 notifies the CPU 162 of the detection result via the sensor IF circuit 73.

The stapler motor 163 is provided in the stapler 51 and driven by the motor driving circuit 75 for driving the stapler 51. Consequently, the stapler 51 executes a stapling process on a sheet. The stapler movement motor 164 is driven by the motor driving circuit 74 for moving the stapler 51 to any position as described above. The position of the stapler 51 is controlled by the CPU 162 based on the result of detection by the stapler position detection sensor 165.

A stapler motor 166 is provided in the stapler 52 and driven by the motor driving circuit 76 for driving the stapler 52. Consequently, the stapler 52 executes a stapleless stapling process on a sheet. When the execution button. 55 is pressed by the user, the execution button 55 transmits a signal corresponding to the pressing to the CPU 162. Further, lighting up or blinking of the LED provided in the execution button 55 is controlled by the CPU 162.

Figure 5:
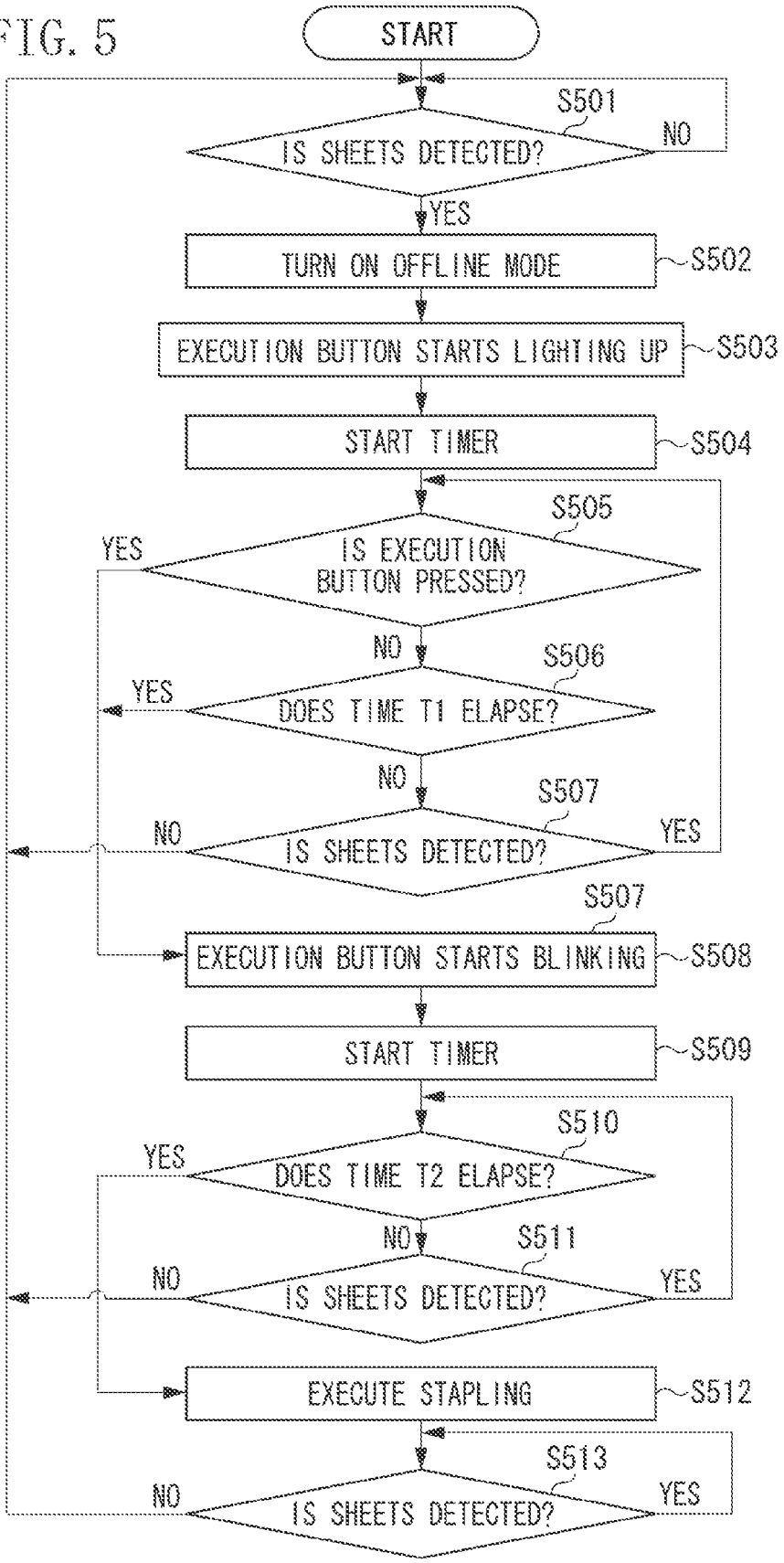
FIG. 5 is a flowchart illustrating an operation of the sheet processing apparatus according to the exemplary embodiment of the present invention.

FIG. 5 is a flowchart illustrating the operation of the sheet processing apparatus 50 when executing a stapling process on a sheet by the offline stapling function. Each operation (step) illustrated in the flowchart in FIG. 5 is achieved by the CPU 162 of the sheet processing apparatus 50 executing a control program stored in the ROM 171.

In step S501, the CPU 162 determines whether the sheet detection sensor 54 detects a sheet. In a case where it is determined that the sheet detection sensor 54 detects a sheet (YES in step S501), the processing proceeds to step S502. In a case where it is determined that the sheet detection sensor 54 does not detect a sheet (NO in step S501), the CPU 162 waits until the sheet detection sensor 54 detects a sheet.

In step S502, the CPU 162 turns on the offline mode. When the offline mode is turned on, the printing of an image by the printing apparatus 1 is restricted. In step S503, the CPU 162 causes the LED of the execution button 55 to light up. This enables the user to know that the execution button 55 can be pressed (an instruction to execute sheet processing can be given). Until the process of step S503 is performed, the pressing of the execution button 55 is not detected, and therefore, a stapling process is not executed even if the execution button 55 is pressed. In step S504, the CPU 162 starts a timer provided in the sheet processing apparatus 50.

In step S505, the CPU 162 determines whether the execution button 55 is pressed. In a case where it is determined that the execution button 55 is pressed (YES in step S505), the processing proceeds to step S508 in a case where it is determined that the execution button 55 is not pressed (NO in step S505), the processing proceeds to step S506. In step S506, the CPU 162 determines whether an elapsed time measured by the timer started in step S504 reaches a predetermined time T1. In a case where it is determined that the elapsed time reaches the predetermined time T1 (YES in step S506), the processing proceeds to step S508. In a case where it is determined that the elapsed time does not reach the predetermined time T1 (NO in step S506), the processing proceeds to step S507. It is assumed that the predetermined time T1 is 3 seconds. Alternatively, the predetermined time T1 may have another length, or may be able to be variably set by the user.

In step S507, the CPU 162 determines whether the sheet detection sensor 54 detects a sheet. In a case where it is determined that the sheet detection sensor 54 detects a sheet (YES in step S507), the processing returns to step S505. In a case where it is determined that the sheet detection sensor 54 does not detect a sheet (NO in step S507), the processing returns to step S501. When the processing returns to step S501, the LED of the execution button 55 goes out, the offline mode is turned off, and the printing restriction is lifted.

In a case where the processing proceeds from step S505 to step S508, sheet processing is executed according to an operation of the user (manually). In a case where, on the other hand, the processing proceeds from step S506 to step S508, sheet processing is executed according to the lapse of the predetermined time (automatically). Possible examples of when the processing returns from step S507 to step S501 include a case where the user once sets a sheet, but changes his/her mind, decides not to execute a stapling process, and pulls out the sheet.

In step S508, the CPU 162 causes the LED of the execution button 55 to start blinking. This enables the user to know that sheet processing is to be executed soon. In step S509, the CPU 162 starts a timer provided in the sheet processing apparatus 50. This timer may be the same as or different from the timer started in step S504. If the same timer is used, the process of resetting the timer is required when the processing proceeds from step S508 to step S509.

In step S510, the CPU 162 determines whether an elapsed time measured by the timer started in step S509 reaches a predetermined time T2. In a case where it is determined that the elapsed time reaches the predetermined time T2 (YES in step S510), the processing proceeds to step S512. In a case where it is determined that the elapsed time does not reach the predetermined time T2 (NO in step S510), the processing proceeds to step S511. It is assumed that the predetermined time T2 is 1 second. Alternatively, the predetermined time T2 may have another length, or may be able to be variably set by the user.

In step S511, the CPU 162 determines whether the sheet detection sensor 54 detects a sheet. In a case where it is determined that the sheet detection sensor 54 detects sheet (YES in step S511), the processing returns to step S510. In a case where it is determined that the sheet detection sensor 54 does not detect a sheet (NO in step S511), the processing returns to step S501. When the processing returns to step S501, the LED of the execution button 55 goes out, the offline mode is turned off, and the printing restriction is lifted. Possible examples of when the processing returns from step S511 to step S501 include a case where the predetermined time T1 elapses since the user has set a sheet, or the user presses the execution button 55, but changes his/her mind, decides not to execute a stapling process, and pulls out the sheet.

In step S512, the CPU 162 causes the stapler 51 to execute a stapling process on a plurality of sheets (inserted into the sheet insertion opening 53) set in the sheet processing apparatus 50. After this, the LED of the execution button 55 goes out, and the offline mode is turned off and the printing restriction is lifted.

In step S513, the CPU 162 determines whether the sheet detection sensor 54 detects a sheet. In a case where it is determined that the sheet detection sensor 54 does not detect a sheet (NO in step S513), the processing returns to step S501. In a case where it is determined that the sheet detection sensor 54 detects a sheet (YES in step S513), the CPU 162 waits until the sheet detection sensor 54 does not detect a sheet. The reason why the processing returns to step S501 under the condition that the sheet detection sensor 54 does not detect a sheet is as follows. This procedure is provided so that the stapling process is not executed on the same position in the same sheet again, if a sheet remains set even after the stapling process is executed.

As described above, in the first exemplary embodiment, after the sheet detection sensor 54 detects a sheet, in a case where the execution button 55 is pressed before the predetermined time T1 elapses, the sheet processing apparatus 50 causes the stapler 51 to execute a stapling process according to the pressing of the execution button 55. Further, in a case where the execution button 55 is not pressed, the sheet processing apparatus 50 causes the stapler 51 to execute a stapling process according to the lapse of the predetermined time T1. Consequently, it is possible to suitably use both the execution of a stapling process according to the reception of an execution instruction from the user and the execution of a stapling process according to the lapse of the predetermined time.

Next, a second exemplary embodiment of the present invention is described. According to the first exemplary embodiment, it is possible to always use both the execution of a stapling process according to the reception of an execution instruction from the user and the execution of a stapling process according to the lapse of the predetermined time. According to the second exemplary embodiment, it is possible to set enabled or disabled for each of the execution of a stapling process according to the reception of an execution instruction from the user (manual execution) and the execution of a stapling process according to the lapse of the predetermined time (automatic execution). Only the differences from the first exemplary embodiment are described below, and the other points are assumed to be similar to those of the first exemplary embodiment.

Figure 6:
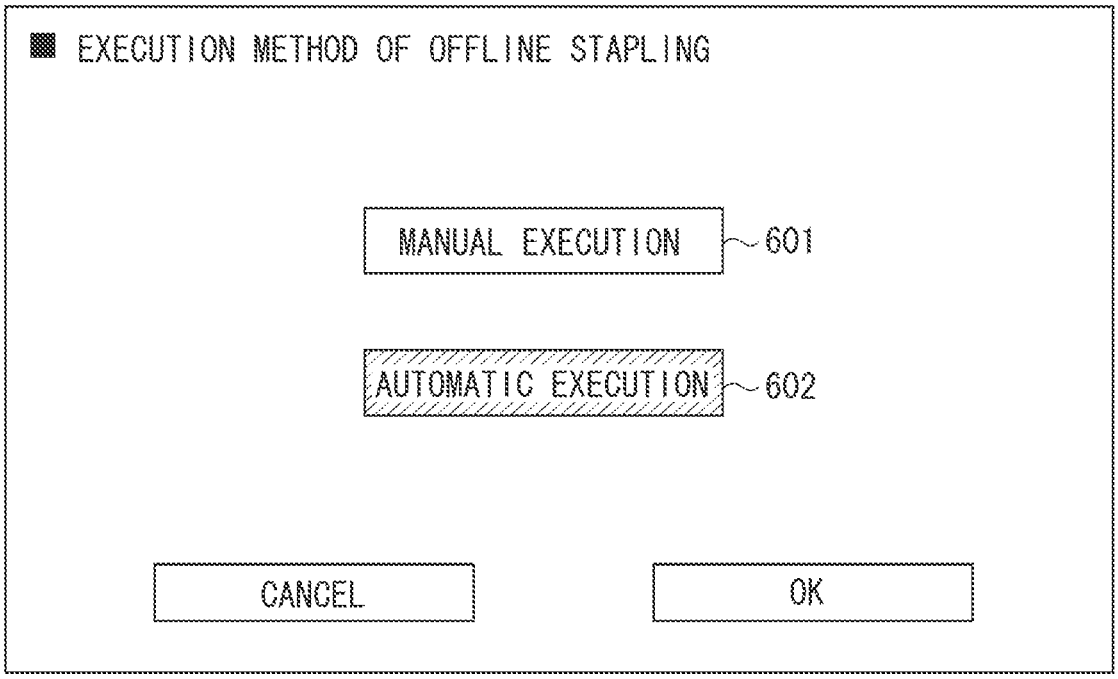
FIG. 6 is a diagram illustrating an example of a setting screen displayed on the printing apparatus according to the exemplary embodiment of the present invention.

FIG. 6 is a diagram illustrating a setting screen displayed on the operation unit 65 of the printing apparatus 1. FIG. 6 illustrates an example of a screen for setting, enabled or disabled, of each of the execution of a stapling process according to the reception of an execution instruction from the user and the execution of a stapling process according to the lapse of the predetermined time. An operation key 601 is used for setting the execution of a stapling process according to the reception of an execution instruction from the user to enable or disable. Every time the operation key 601 is pressed, an enabled state and a disabled state are switched. An operation key 602 is used for setting the execution of a stapling process according to the lapse of the predetermined time to enable or disable. Every time the operation key 602 is pressed, an enabled state and a disabled state are switched. Each of the operation keys 601 and 602 can be independently set. The settings made through this setting screen are stored in the ROM 171, which is configured to be writable.

Figures 7, 7A:
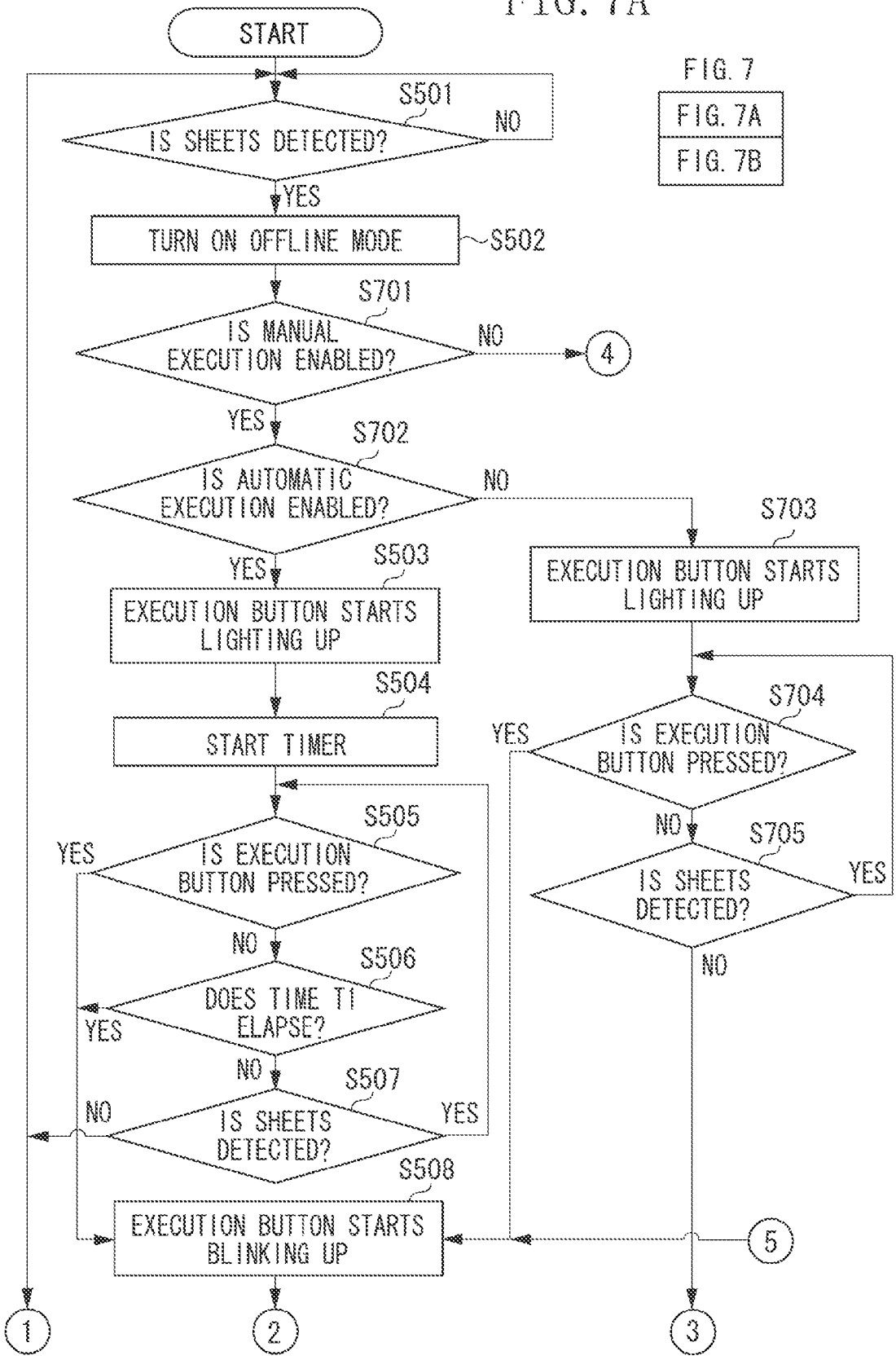
FIG. 7 (consisting of FIGS. 7A and 7B) is a flowchart illustrating an operation of the sheet processing apparatus according to an exemplary embodiment of the present invention.
Figure 7B:
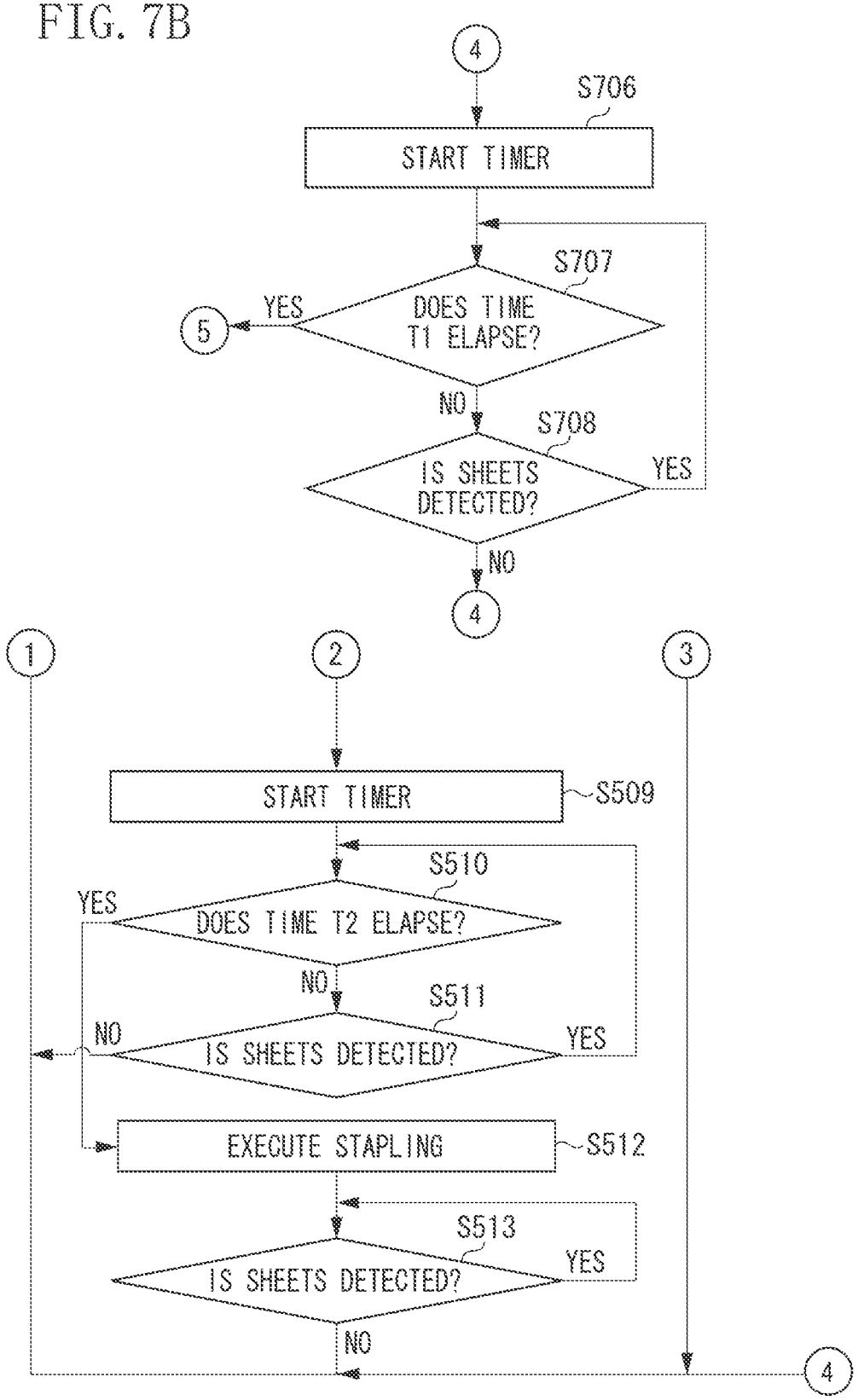

FIG. 7 (consisting of FIGS. 7A and 7B) is a flowchart illustrating the operation of the sheet processing apparatus 50 when a stapling process is executed on a sheet by the offline stapling function, and corresponds to the flowchart in FIG. 5 described in the first exemplary embodiment. It can be seen that by comparison with the flowchart in FIG. 5, the flowchart in FIG. 7 additionally includes steps S701 to S708.

In step S501, the CPU 162 determines whether the sheet detection sensor 54 detects a sheet. In a case where it is determined that the sheet detection sensor 54 detects a sheet (YES in step S501), the processing proceeds to step S502. In a case where it is determined that the sheet detection sensor 54 does not detect a sheet (NO in step S501), the CPU 162 waits until the sheet detection sensor 54 detects a sheet. In step S502, the CPU 162 turns on the offline mode. When the offline mode is turned on, the printing of an image by the printing apparatus 1 is restricted.

In step S701, based on information stored in the ROM 171, the CPU 162 determines whether the execution of a stapling process according to the reception of an execution instruction from the user is set to enable. In a case where it is determined that the execution is set to enable (YES in step S701), the processing proceeds to step S702. In a case where it is determined that the execution is not set to enable (is set to disabled) (NO in step S701), the processing proceeds to step S706 in step S702, based on information stored in the ROM 171, the CPU 162 determines whether the execution of a stapling process according to the lapse of the predetermined time is set to enable. In a case where it is determined that the execution is set to enable (YES in step S702), the processing proceeds to step S503. In a case where it is determined that the execution is not set to enable (is set to disable) (NO in step S702), the processing proceeds to step S703.

In this process, the processing proceeds to step S503 in a case where both the execution of a stapling process according to the reception of an execution instruction from the user and the execution of a stapling process according to the lapse of the predetermined time are set to enable. Further, the processing proceeds to step S703 in a case where the execution of a stapling process according to the reception of an execution instruction from the user is set to enable, and the execution of a stapling process according to the lapse of the predetermined time is set to disabled. Further, the processing proceeds to step S706 in a case where the execution of a stapling process according to the reception of an execution instruction from the user is set to disabled, and the execution of a stapling process according to the lapse of the predetermined time is set to enable. It is assumed here that there is no case where both types of execution are set to disabled. If, however, it is allowed to set both types of execution to disabled, this flowchart may not be started (the sheet detection sensor 56 may not perform a detection of sheet) in a case where both types of execution are set to disabled.

The processes of steps S503 to S513 are similar to those described in the flowchart in FIG. 5 and therefore are not described here. In step S703, the CPU 162 causes the LED of the execution button 55 to light up. This enables the user to know that the execution button 55 can be pressed (an instruction to execute sheet processing can be given).

In step S704, the CPU 162 determines whether the execution button 55 is pressed. In a case where it is determined that the execution button 55 is pressed (YES in step S704), the processing proceeds to step S508. In a case where it is determined that the execution button 55 is not pressed (NO in step S704), the processing proceeds to step S705. In step S705, the CPU 162 determines whether the sheet detection sensor 54 detects a sheet. In a case where it is determined that the sheet detection sensor 54 detects a sheet (YES in step S705), the processing returns to step S704 in a case where it is determined that the sheet detection sensor 54 does not detect a sheet (NO in step S705), the processing returns to step S501. When the processing returns to step S501, the LED of the execution button 55 goes out, the offline mode is turned off, and the printing restriction is lifted. Possible examples of when the processing returns from step S705 to step S501 include a case where the user once sets a sheet, but changes his/her mind, decides not to execute a stapling process, and pulls out the sheet. In a case where the processing proceeds from step S702 to step S703, a stapling process is not executed even if the time in which the sheet detection sensor 54 continues to detect a sheet reaches the predetermined time T1.

In step S706, the CPU 162 starts a timer provided in the sheet processing apparatus 50. In step S707, the CPU 162 determines whether an elapsed time measured by the timer started in step S706 reaches the predetermined time T1. In a case where it is determined that the elapsed time reaches the predetermined time T1 (YES in step S707), the processing proceeds to step S508. In a case where it is determined that the elapsed time does not reach the predetermined time T1 (NO in step S707), the processing proceeds to step S708. It is assumed that the predetermined time T1 is 3 seconds as described in step S506 in FIG. 5. Alternatively, the predetermined time T1 may have another length, or may be able to be variably set by the user.

In step S708, the CPU 162 determines whether the sheet detection sensor 54 detects a sheet. In a case where it is determined that the sheet detection sensor 54 detects a sheet (YES in step S708), the processing returns to step S707. In a case where it is determined that the sheet detection sensor 54 does not detect a sheet (NO in step S708), the processing returns to step S501. When the processing returns to step S501, the LED of the execution button 55 goes out, the offline mode is turned off, and the printing restriction is lifted. Possible examples of when the processing returns from step S708 to step S501 include case where the user once sets a sheet, but changes his/her mind, decides not to execute a stapling process, and pulls out the sheet. In a case where the processing proceeds from step S701 to step S706, a stapling process is not executed even if the execution button 55 is pressed.

As described above, according to the second exemplary embodiment, enabled or disabled can be set for each of the execution of a stapling process according to the reception of an execution instruction from the user (manual execution) and the execution of a stapling process according to the lapse of the predetermined time (automatic execution). Consequently, it is possible to adapt the present invention to an environment requiring only either one of the execution of a stapling process according to the reception of an execution instruction from the user (manual execution) and the execution of a stapling process according to the lapse of the predetermined time (automatic execution).

Next, a third exemplary embodiment of the present invention is described. According to the second exemplary embodiment, it is possible to set to enable or disable for each of the execution of a stapling process according to the reception of an execution instruction from the user (manual execution) and the execution of a stapling process according to the lapse of the predetermined time (automatic execution). According to the third exemplary embodiment, the setting of whether to set to enable or disable for each of the execution of a stapling process according to the reception of an execution instruction from the user (manual execution) and the execution of a stapling process according to the lapse of the predetermined time (automatic execution) is stored in advance in a manner such that the setting is associated with each user. Only the differences from the second exemplary embodiment are described below, and the other points are assumed to be similar to those of the second exemplary embodiment.

FIG. 8 is a diagram illustrating a user management table stored in the ROM 171 of the sheet processing apparatus 50. As illustrated in FIG. 8, the setting of whether to set to enable or disable for each of the execution of a stapling process according to the reception of an execution instruction from the user (manual execution) and the execution of a stapling process according to the lapse of the predetermined time (automatic execution) is managed in a manner such that the setting is associated with each user. It is assumed that this user management table is updated by the administrator of the printing apparatus 1. Alternatively, each user may be able to update the user management table themselves.

Figure 9B:
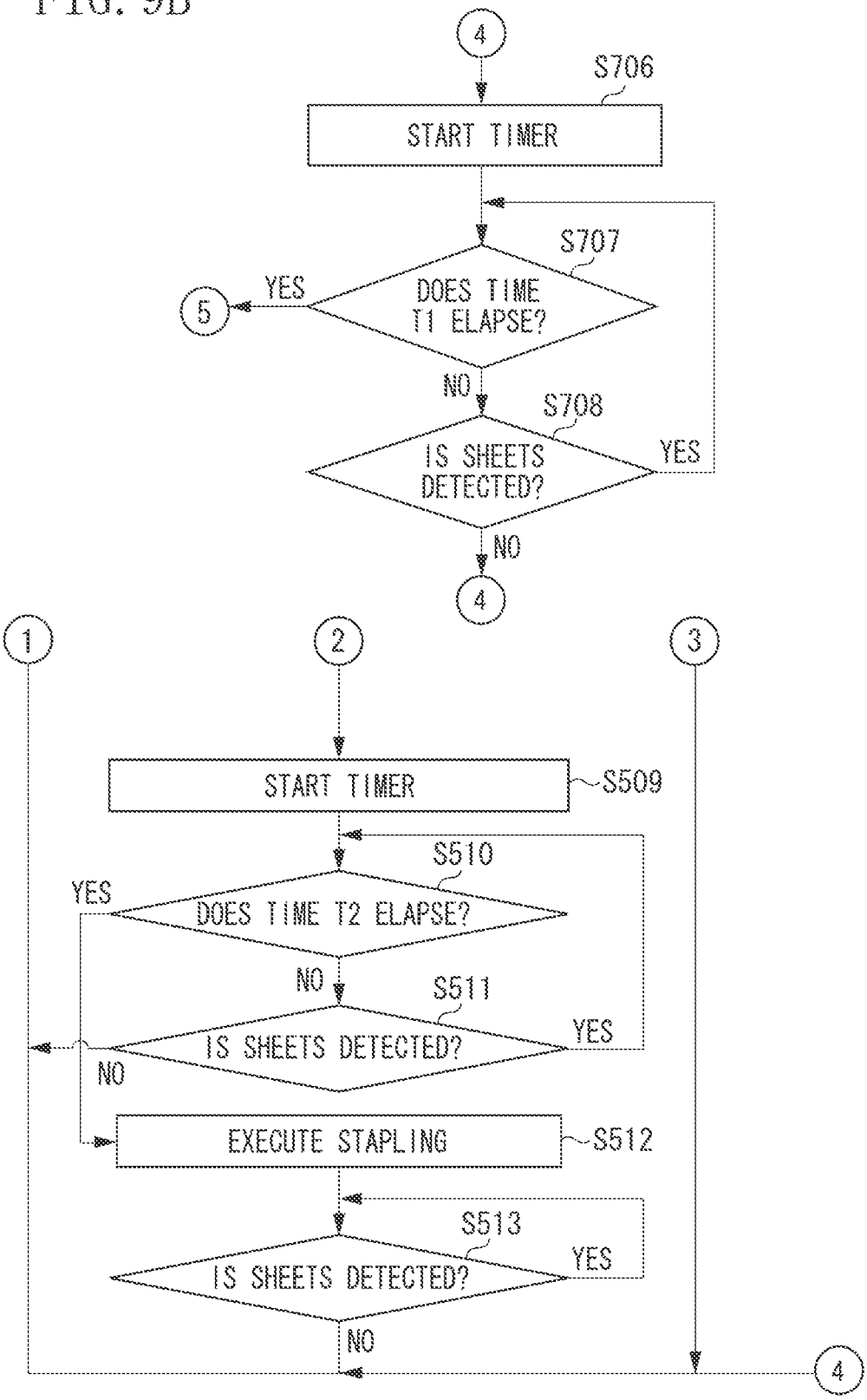
FIG. 9 (consisting of FIGS. 9A and 9B) is a flowchart illustrating an operation of the sheet processing apparatus according to the exemplary embodiment of the present invention.

FIG. 9 (consisting of FIGS. 9A and 9B) is a flowchart illustrating the operation of the sheet processing apparatus 50 when executing a stapling process on a sheet by the offline stapling function, and corresponds to the flowchart in FIG. 7 described in the second exemplary embodiment. It can be seen that by comparison with the flowchart in FIG. 7, the flowchart in FIG. 9 additionally includes steps S901 and S902. Steps S903 and S904 are also added instead of steps S701 and S702.

In step S901, the CPU 162 acquires, from the printing apparatus 1, information of a user logging into the printing apparatus 1, thereby identifying a use currently using the printing apparatus 1. It is assumed that the information to be acquired in this process is a user identification (ID) input by the user when the user logs into the printing apparatus 1. Alternatively, the information may be another piece of information. In step S902, the CPU 162 determines whether the user logs out of the printing apparatus 1. In a case where it is determined that the user does not log out (NO in step S902), the processing proceeds to step S501 in a case where it is determined that the user logs out (YES in step S902), the processing ends.

In step S501, the CPU 162 determines whether the sheet detection sensor 54 detects a sheet. In a case were it is determined that the sheet detection sensor 54 detects a sheet (YES in step S501), the processing proceeds to step S502. In a case where it is determined that the sheet detection sensor 54 does not detect a sheet (NO in step S501), the processing returns to step S902. In step S502, the CPU 162 turns on the offline mode. When the offline mode is turned on, the printing of an image by the printing apparatus 1 is restricted.

In step S903, based on the user identified in step S901 and the user management table illustrated in FIG. 8, the CPU 162 determines whether the execution of a stapling process according to the reception of an execution instruction from the user is set to enable for the user currently using the printing apparatus 1. In a case where it is determined that the execution is set to enable (YES in step S903), the processing proceeds to step S904. In a case where it is determined that the execution is not set to enable (is set to disabled) (NO in step S903), the processing proceeds to step S706. In step S904, based on the user identified in step S901 and the user management table illustrated in FIG. 8, the CPU 162 determines whether the execution of a stapling process according to the lapse of the predetermined time is set to enable for the user currently using the printing apparatus 1. In a case where it is determined that the execution is set to enable (YES in step S904), the processing proceeds to step S503 in a case where it is determined that the execution is not set to enable set to disabled) (NO in step S904), the processing proceeds to step S703.

In this process, the processing proceeds to step S503 in a case where both the execution of a stapling process according to the reception of an execution instruction from the user and the execution of a stapling process according to the lapse of the predetermined time are set to enable. Further, the processing proceeds to step S703 in a case where the execution of a stapling process according to the reception of an execution instruction from the user is set to enable, and the execution of a stapling process according to the lapse of the predetermined time is set to disabled. Further, the processing proceeds to step S706 in a case where the execution of a stapling process according to the reception of an execution instruction from the user is set to disabled, and the execution of a stapling process according to the lapse of the predetermined time is set to enable. It is assumed here that there is no case where both types of execution are set to disabled. If, however, it is allowed to set both types of execution to disabled, this flowchart may not be started (the sheet detection sensor 56 may not perform a detection of sheet) in a case where both types of execution are set to disabled.

The processes of steps S503 to S513 are similar to those described in the flowchart in FIG. 5 and therefore are not described here. Further, the processes of steps S703 to S708 are similar to those described in the flowchart in FIG. 7 and therefore are not described here.

As described above, according to the third exemplary embodiment, the setting of whether to set enable or disabled for each of the execution of a stapling process according to the reception of an execution instruction from the user (manual execution) and the execution of a stapling process according to the lapse of the predetermined time (automatic execution) is stored in a manner such that the setting is associated with each user. Consequently, even when there are a user who needs only the execution of a stapling process according to the reception of an execution instruction from the user (manual execution), and a user who needs only the execution of a stapling process according to the lapse of the predetermined time (automatic execution), it is possible to improve usability. Further, the following mode may be provided. Even if the function of authenticating a user and allowing the user to log into the printing apparatus 1 is being used on the printing apparatus 1 side, a stapling process in the offline mode can be used without a login. If this mode is set, the processing described in the first or second exemplary embodiment is executed.

In the first to third exemplary embodiments, only a stapling process using a staple by the stapler 51 has been described as a target for the offline stapling function. Alternatively, the present invention may be applied to a stapleless stapling process without the use of a staple by the stapler 52. Yet alternatively, the present invention can also be applied to a punching process by a puncher (not illustrated). Further, in the first to third exemplary embodiments, a sheet processing apparatus connected to a printing apparatus has been described as an example. Alternatively, the present invention may be applied to a sheet processing apparatus not connected to a printing apparatus.

OTHER EMBODIMENTS

Embodiment (s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment (s) and/or that includes one or more circuits (e.g., application specific integrated circuit (ASIC)) for performing the functions of one or more of the above-described embodiment (s), and by a method performed by the computer of the system or apparatus by, for example, reading out and executing the computer executable instructions from the storage medium to perform the functions of one or more of the above-described embodiment (s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent. Application No. 2014-263177, filed Dec. 25, 2014, which is hereby incorporated by reference herein in its entirety.

What is claimed is:

1. A sheet processing apparatus comprising:

a sheet processing unit configured to execute sheet processing;

a detection unit configured to detect a sheet as a processing target;

a reception unit configured to receive an execution instruction to execute the sheet processing from a user;

a control unit configured to, after the detection unit detects a sheet, in a case where the reception unit receives the execution instruction before a predetermined time elapses, cause the sheet processing unit to execute the sheet processing according to reception of the execution instruction, and in a case where the reception unit does not receive the execution instruction, cause the sheet processing unit to execute the sheet processing according to lapse of the predetermined time; and a setting unit configured to set whether execution of the sheet processing according to the lapse of the predetermined time is enabled.

2. The sheet processing apparatus according to claim 1, wherein the sheet processing apparatus is connected to a printing apparatus and is able to execute sheet processing involving printing and sheet processing not involving printing.

3. The sheet processing apparatus according to claim 1, wherein the sheet processing is a stapling process for binding a plurality of sheets.

4. The sheet processing apparatus according to claim 1, wherein according to the detection unit detecting a sheet, the reception unit shifts to a state in which the reception unit is able to receive the execution instruction.

5. The sheet processing apparatus according to claim 1, wherein after the detection unit detects a sheet, in a case where the reception unit does not receive the execution instruction and the detection unit does not detect a sheet before the predetermined time elapses, the sheet processing unit does not execute the sheet processing.

6. The sheet processing apparatus according to claim 1, wherein the setting unit further sets whether execution of the sheet processing according to the reception of the execution instruction is enabled.

7. A method for controlling a sheet processing apparatus including a sheet processing unit configured to execute sheet processing, the method comprising:

detecting a sheet as a processing target;

receiving an execution instruction to execute the sheet processing from a user;

after a sheet is detected in the detecting, in a case where the execution instruction is received in the receiving before a predetermined time elapses, causing the sheet processing unit to execute the sheet processing according to reception of the execution instruction, and in case where the execution instruction is not received in the receiving, causing the sheet processing unit to execute the sheet processing according to lapse of the predetermined time; and setting whether execution of the sheet processing according to the lapse of the predetermined time is enabled.

8. The method according to claim 7, further comprising executing sheet processing involving printing and sheet processing not involving printing.

9. The method according to claim 7, wherein the sheet processing is a stapling process for binding a plurality of sheets.

10. The method according to claim 7, wherein according to the detecting a sheet, the receiving shifts to a state in which the receiving is able to receive the execution instruction.

11. The method according to claim 7, wherein after the detecting detects a sheet, in a case where the receiving does not receive the execution instruction and the detecting does not detect a sheet before the predetermined time elapses, the sheet processing is not executed.

12. The method according to claim 7, wherein the setting further sets whether execution of the sheet processing according to the reception of the execution instruction is enabled.

13. A non-transitory computer-readable storage medium storing a program that causes a computer to perform a method for controlling a sheet processing apparatus including a sheet processing unit configured to execute sheet processing, the method comprising:

detecting a sheet as a processing target;

receiving an execution instruction to execute the sheet processing from a user;

after a sheet is detected in the detecting, in a case where the execution instruction is received in the receiving before a predetermined time elapses, causing the sheet processing unit to execute the sheet processing according to reception of the execution instruction, and in a case where the execution instruction is not received in the receiving, causing the sheet processing unit to execute the sheet processing according to lapse of the predetermined time; and setting whether the execution of the sheet processing according to the lapse of the predetermined time is enabled.

14. The non-transitory computer-readable storage medium according to claim 13, further comprising executing sheet processing involving printing and sheet processing not involving printing.

15. The non-transitory computer-readable storage medium according to claim 13, wherein the sheet processing is a stapling process for binding a plurality of sheets.

16. The non-transitory computer-readable storage medium according to claim 13, wherein according to the detecting a sheet, the receiving shifts to a state in which the receiving is able to receive the execution instruction.

17. The non-transitory computer-readable storage medium according to claim 13, wherein after the detecting detects a sheet, in a case where the receiving does not receive the execution instruction and the detecting does not detect a sheet before the predetermined time elapses, the sheet processing is not executed.

18. The non-transitory computer-readable storage medium according to claim 13, wherein the setting further sets whether execution of the sheet processing according to the reception of the execution instruction is enabled.

* * * * *